US005403215A

United States Patent [19]

Buchter et al.

[11] Patent Number: 5,403,215

[45] Date of Patent: Apr. 4, 1995

[54] ELECTRICAL CONNECTOR WITH IMPROVED CONTACT RETENTION

[75] Inventors: Randolph L. Buchter, Harrisburg; Timothy L. Kocher, Camp Hill; Ronald W. Brennian, Jr., Elizabethtown; Ivan P. Kerns, Carlisle; Edmund F. Shultz, Jr., Hummelstown, all of Pa.

[73] Assignee: The Whitaker Corporation, Wilmington, Del.

[21] Appl. No.: 171,046

[22] Filed: Dec. 19, 1993

[51] Int. Cl.[6] ..... H01R 9/16; H01R 13/41

[52] U.S. Cl. ..... 439/869; 439/733

[58] Field of Search ..... 439/733, 746, 751, 869, 439/873

[56] References Cited

U.S. PATENT DOCUMENTS

| | | | |
|---|---|---|---|
| 4,666,231 | 5/1988 | Sheesley et al. | 339/177 |
| 4,731,034 | 3/1988 | Hagan et al. | 439/891 |
| 4,921,436 | 5/1990 | Sole et al. | 439/395 |
| 5,064,391 | 11/1991 | Buchter | 439/733 |
| 5,112,233 | 5/1992 | Lybrand | 439/79 |
| 5,152,700 | 10/1992 | Bogursky et al. | 439/733 |
| 5,190,483 | 3/1993 | Viselli | 439/751 |
| 5,263,882 | 11/1993 | Peterson | 439/869 X |

*Primary Examiner*—Eugene F. Desmond
*Attorney, Agent, or Firm*—Bruce J. Wolstoncroft

[57] ABSTRACT

A contact (10) has an intermediate body portion (11) provided with respective side edges (14, 15) formed with a protruding convex portion (16) and a recessed concave portion (17), respectively. The contacts (10) are slidably inserted into respective channels (22) in the insulated housing (21) of an electrical connector (20), the channels (22) being separated by respective walls (23). When the contacts (10) are thus inserted into the channels (22), the convex portion (16) of one contact (10) cooperates with the concave portion (17) of an adjacent contact (10) to trap and deform the wall (23) therebetween, thereby exerting a resilient biasing force for retaining each contact (10) in its respective channel (22).

9 Claims, 3 Drawing Sheets

ELECTRICAL CONNECTOR WITH IMPROVED CONTACT RETENTION

FIELD OF THE INVENTION

The present invention relates to an electrical connector and, more particularly, to an electrical connector including a plurality of contacts having a superior retention system.

BACKGROUND OF THE INVENTION

Electrical connectors are used for connecting cables or other components in the electronic and aerospace industries. These electrical connectors include an insulated or dielectric housing having a plurality of respective channels receiving a corresponding plurality of contacts. These contacts are usually relatively thin, are elongated longitudinally, and have respective end portions providing terminals or equivalent elements. Each of the contacts has a body portion including side edges, and each of the side edges is provided with one or more laterally-projecting barbs. These barbs engage the respective sides of the channel in the insulated housing to effect an interference or press-fit therebetween, thereby retaining the contact within its respective channel.

The contacts are inserted into their respective channels using high-speed automated equipment for producing a low-cost high-quality reliable product.

The trend in electrical connectors is higher circuit density for product miniaturization without sacrificing product reliability. With higher circuit density, the contacts are necessarily smaller and are spaced closer together. As a result, the barbs on the contacts may not provide the desired retention force, especially where the electrical connector is intended for repeated "make and break" engagement over an extended period of time.

Barbs are also ineffective in applications in which the walls of the housing are configured for high density applications, i.e. when the walls are relatively thin to conserve space. In these instances, the barbs can break through the plastic and make electrical contact with the adjacent contact terminal. This causes an electrical short which prevents the connector from operating properly.

SUMMARY OF THE INVENTION

Accordingly, it is an object of the present invention to provide an electrical connector having an improved retention system for the plurality of contacts therein.

In accordance with the teachings of the present invention, an electrical connector includes an insulated housing having a plurality of contacts positioned in thin walled cavities or channels, including at least first and second adjacent channels having respective portions separated therefrom by a thin wall; and the wall has at least a portion thereof which may flex or be deformed. A plurality of contacts, including at least first and second contacts, are slidably inserted into the first and second channels, respectively. Each of the contacts is longitudinal and includes an intermediate body portion having first and second side edges, respectively. The first side edge includes a portion protruding laterally therefrom, and the second side edge includes a recessed portion. With this structure, the protruding portion of the first side edge of the second contact cooperates with the recessed portion of the second side edge of the first contact to trap the portion of the wall therebetween. As a result, the portion of the wall is deformed during the slidable insertion of the first and second contacts into the first and second channels, respectively, thereby providing a lateral biasing force on the respective contacts for improved retention of the contacts in the respective channels.

In one embodiment, the protruding portion comprises a convex portion, and the recessed portion comprises a concave portion and nests with respects to the convex portion. Preferably, the first side edge of each contact is further provided with a pair of recesses, one on each side of the convex portion.

In one case, each contact has a pair of spaced-apart arms integrally formed with the intermediate body portion of the contact and projecting longitudinally therefrom, and each contact further has a solder lead integrally formed with the intermediate body portion of the contact and projecting longitudinally therefrom oppositely of the pair of spaced-apart arms.

The plurality of contacts may be arranged in a row of contacts, and the electrical connector may include multiple rows of contacts.

These and other objects of the present invention will become apparent from a reading of the following specification taken in conjunction with the enclosed drawings.

DETAILED DESCRIPTION OF THE INVENTION

Figure 1:
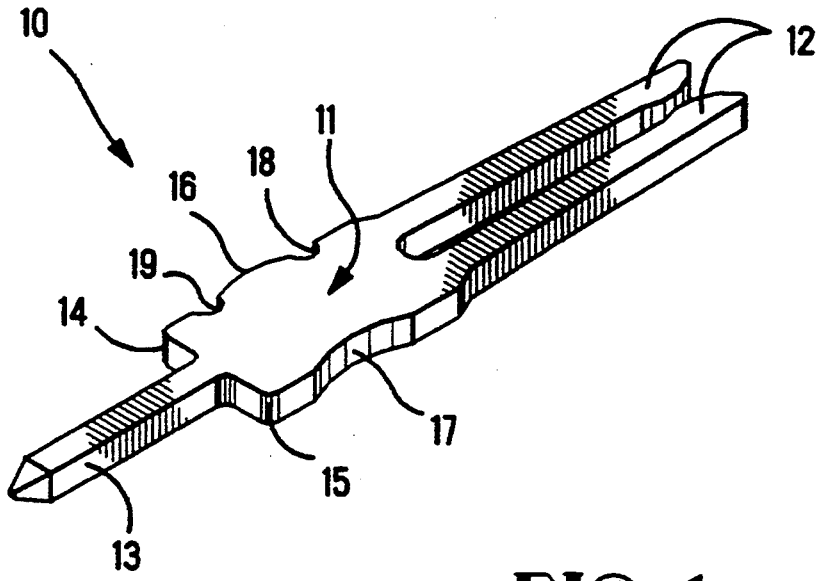
FIG. 1 is a perspective view of an individual contact of the present invention.

With reference to FIG. 1, the improved contact 10 of the present invention is generally an elongated relatively-thin member which is stamped out and formed from a suitable metal and, if desired, may be plated for electrical conductivity purposes. The contact 10 has an intermediate body portion 11, a pair of spaced-apart arms 12 at one end thereof and formed integrally therewith, and a solder lead 13 at the other and opposite end and, again, formed integrally therewith. It will be appreciated by those skilled in the art, however, that the particular contact 10 is only exemplary of a wide variety of contacts and equivalent members with which the present invention may find more particular utility.

With this in mind, the intermediate body portion 11 of each contact 10 has first and second side edges 14 and 15, respectively. The first side edge 14 is provided with a protruding portion 16 (which is preferably convex) while the opposite second side edge 15 has a recessed portion 17 (which is preferably concave). The first side edge 14 is further provided with a pair of recesses 18 and 19, respectively, on each side of the protruding convex portion 16.

Figure 2:
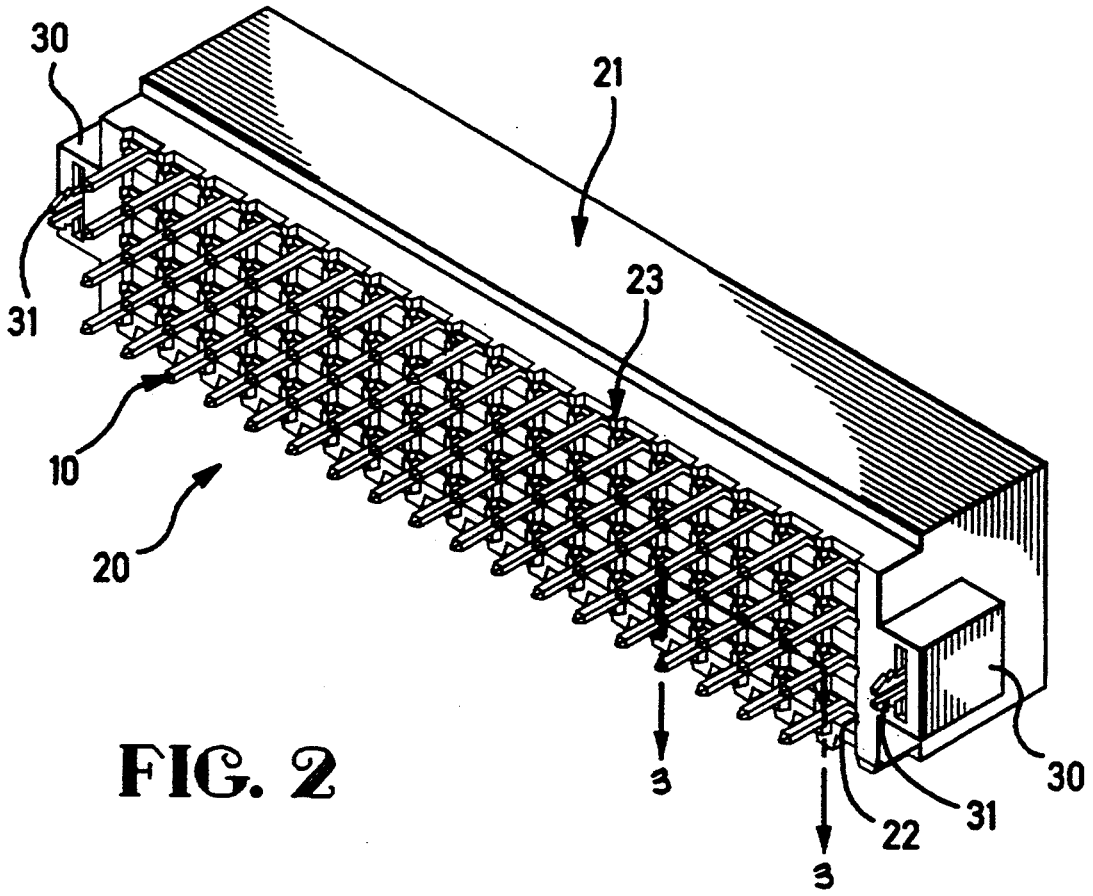
FIG. 2 is a perspective view of a typical electrical connector with which the teachings of the present invention may find particular utility, showing the multiple rows of contacts in the respective channels in the electrical connector.

With further reference again to FIGS. 2–4, the contacts 10 are arranged in multiple rows in a electrical connector 20 including a dielectric or insulated housing 21 having multiple rows of respective channels 22. These channels 22 are separated by integrally-molded walls 23 within the housing 21, and each wall 23 has a reduced cross-section deformable portion 24.

Figure 5:
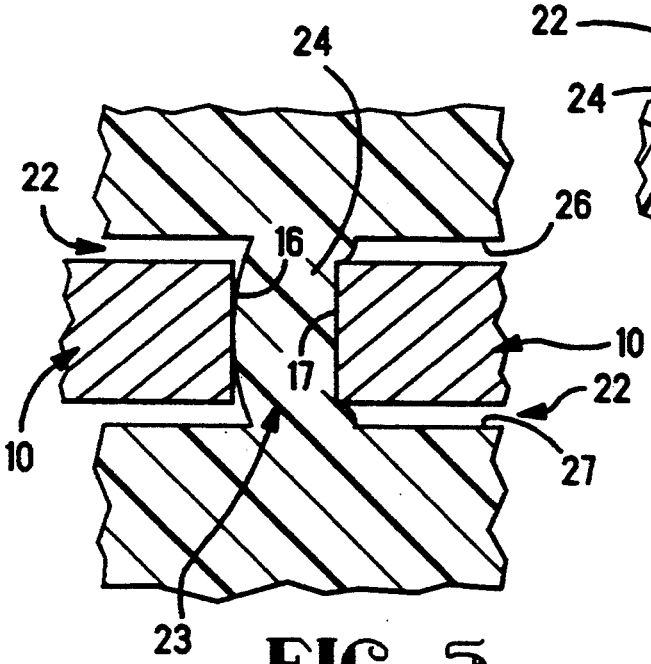
FIG. 5 is a cross-sectional view, taken across the lines 5—5 of FIG. 3, and drawn to an enlarged scale.
Figure 4:
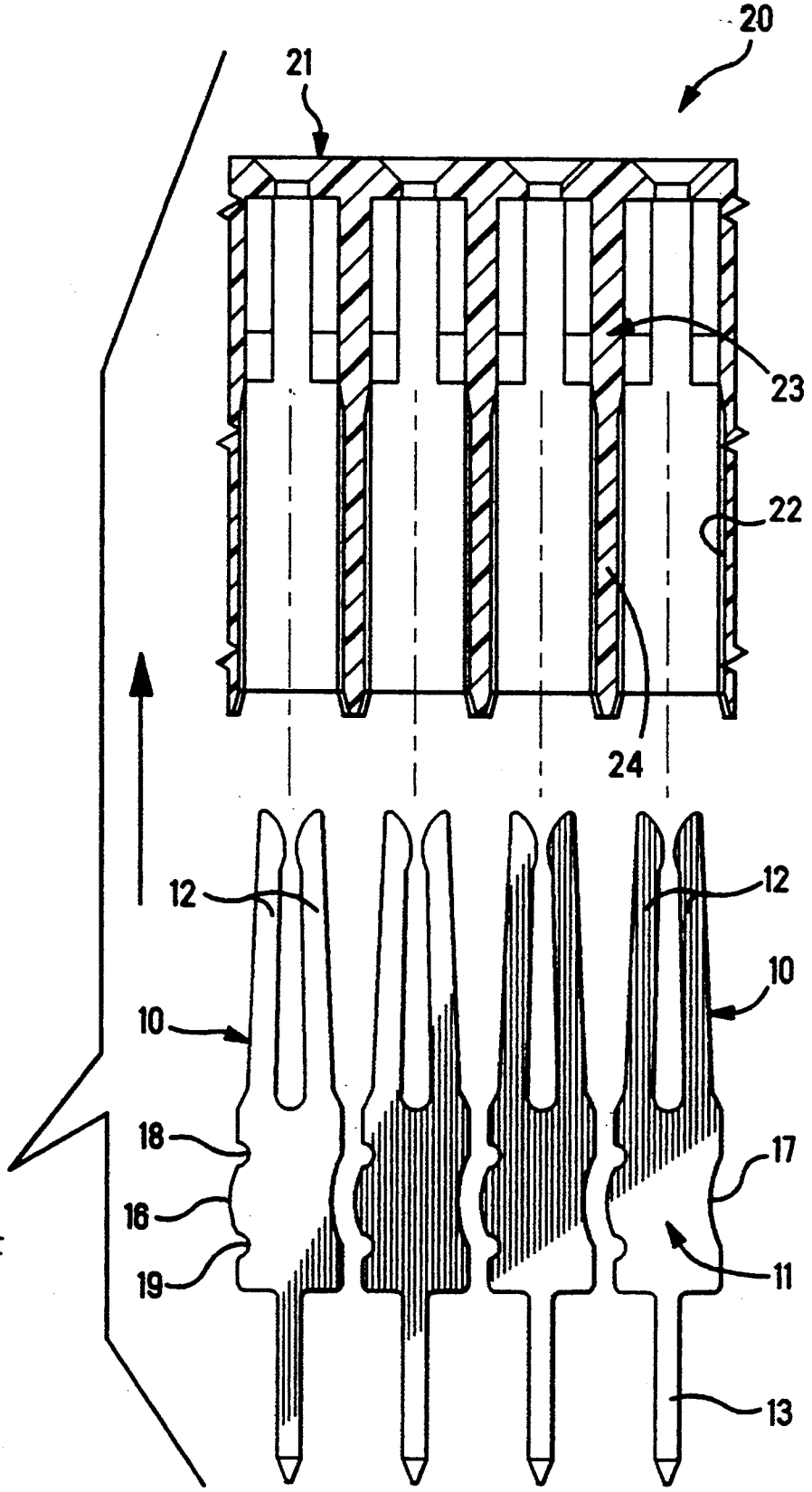
FIG. 4 corresponds substantially to FIG. 3, but shows the contacts in an exploded relationship with respect to the channels in the electrical connector.

As shown more clearly in FIG. 4, the convex protruding portion 16 of the contact 10 is complementary to (and nests with) the concave recessed portion 17 of the adjacent contact 10 so as to trap the wall portion 24 therebetween and, more significantly, to flex or deform the wall portion 24 as shown more clearly in FIG. 5. As a result, a lateral biasing force is exerted on each contact 10, substantially transversely thereof, to provide an improved (and superior) retention of each contact 10 in its respective channel 22. It is worth noting, that the recesses 18, 19, provided on either side of the protruding convex portion 16, allow the plastic walls to relax and conform to the shape of the portion 16, thereby providing for a more effective retention of the contact 10 in the channels or cavities 22.

Figure 3:
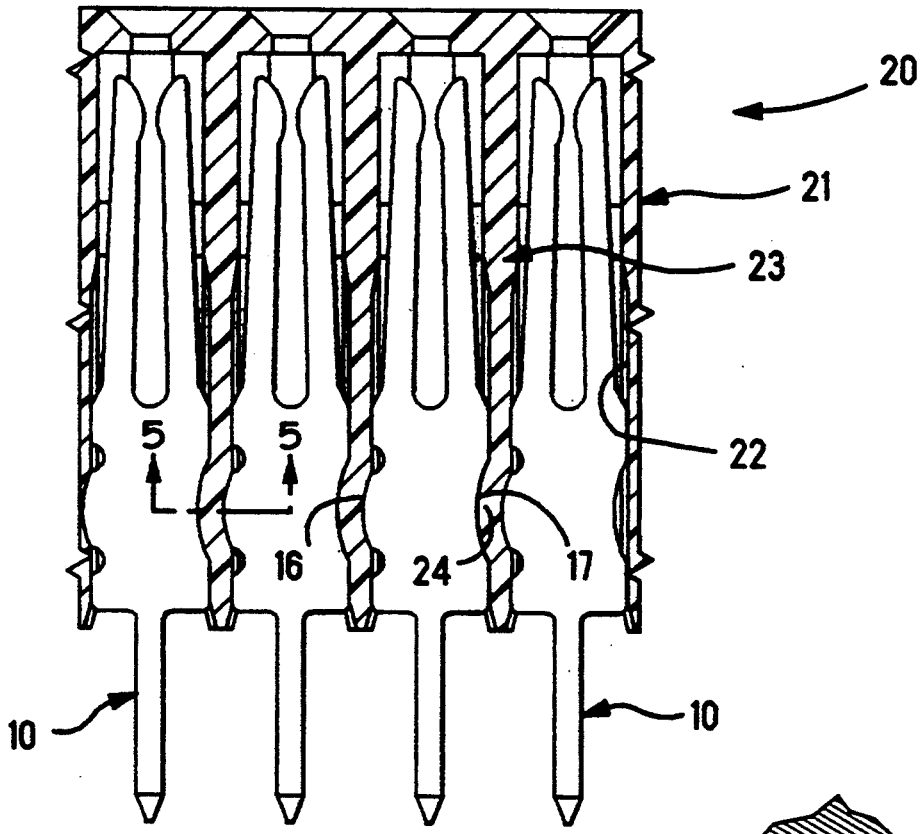
FIG. 3 is a partial cross-sectional view, taken across the lines 3—3 of FIG. 2, and showing some of the contacts arranged in a side-by-side relationship in their respective channels in the electrical connector.

As is best shown in FIG. 3, each respective contact contributes to the lateral biasing force exerted on its adjacent contact. This provides an interlocking configuration between the contacts.

Figure 6:
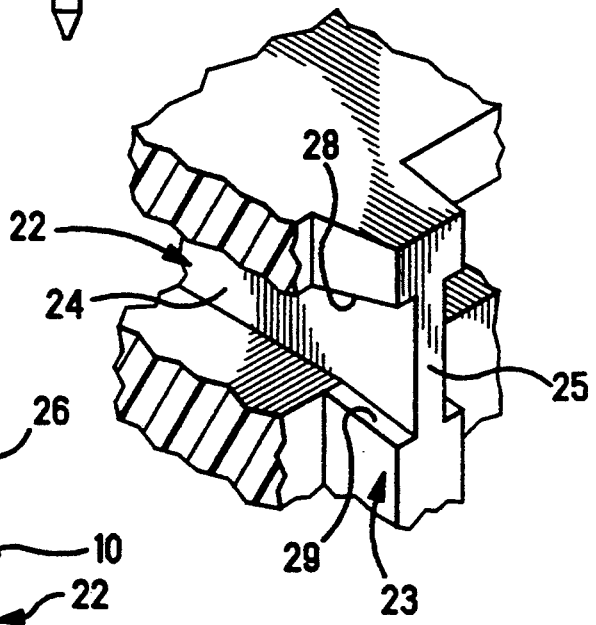
FIG. 6 is a perspective view of one of the channels in the insulated housing of the electrical connector, showing the respective ramps for slidably guiding the respective contact therein.

With further reference to FIGS. 5 and 6, each wall 23 has a reduced cross-section web portion 25 which has a top surface 26 and a bottom surface 27. The surfaces are provided to cooperate with surfaces of the contacts 10 to better retain the contacts in the channels. These surfaces 26 and 27 have inclined ramps 28 and 29, respectively, to facilitate the slidable insertion of each contact 10 into its respective channel 22 during the automated manufacturing process.

With reference again to FIG. 2, the insulated housing 21 for the electrical connector 20 has a pair of bosses 30, each of which is provided with a pair of spring-loaded latching fingers 31 for mating engagement with a printed circuit board (not shown) or the like. These fingers provide the means to temporarily secure the connector to the board until the contacts 10 are permanently soldered to the board.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. An electrical connector, comprising an insulated housing having a plurality of channels formed therein, including at least first and second adjacent channels having respective portions separated therefrom by a wall, the wall having at least a portion thereof which is substantially deformable, a plurality of contacts including at least first and second contacts slidably inserted into the first and second channels, respectively, each of the contacts being longitudinal and including an intermediate body portion having first and second side edges, respectively, the first side edge including a portion protruding laterally therefrom, and the second side edge including a recessed portion, such that the protruding portion of the first side edge of the second contact cooperates with the recessed portion of the second side edge of the first contact to trap the portion of the wall therebetween, and such that the portion of the wall is deformed during the slidable insertion of the first and second contacts into the first and second channels, respectively, thereby providing a lateral biasing force on the respective contacts for improved retention of the contacts in the respective channels.

2. The electrical connector of claim 1, wherein the protruding portion comprises a convex portion, and wherein the recessed portion comprises a concave portion and nests with respects to the convex portion.

3. The electrical connector of claim 2, wherein the first side edge of each contact is further provided with a pair of recesses, one on each side of the convex portion.

4. The electrical connector of claim 1, wherein each contact has a pair of spaced-apart arms integrally formed with the intermediate body portion of the contact and projecting longitudinally therefrom.

5. The electrical connector of claim 4, wherein each contact further has a solder lead integrally formed with the intermediate body portion of the contact and projecting longitudinally therefrom oppositely of the pair of spaced-apart arms.

6. The electrical connector of claim 1, wherein the plurality of contacts is arranged in a row of contacts.

7. The electrical connector of claim 6, further including multiple rows of contacts.

8. An electrical connector, comprising an insulated housing having multiple rows of channels formed therein, each row having a plurality of individual channels formed therein, including at least first and second adjacent channels having respective portions separated therefrom by a wall, the wall having at least a portion thereof which is substantially deformable, a plurality of contacts including at least first and second contacts slidably inserted into the first and second channels, respectively, each of the contacts being longitudinal and including an intermediate body portion having first and second side edges, respectively, the first side edge including a convex portion protruding laterally therefrom, and the second side edge including a recessed concave portion, such that the convex protruding portion of the first side edge of the second contact cooperates with the recessed concave portion of the second side edge of the first contact to trap the portion of the wall therebetween, and such that the portion of the wall is deformed during the slidable insertion of the first and second contacts into the first and second channels, respectively, thereby providing a lateral biasing force on the respective contacts for improved retention of the contacts in the respective channels.

9. An electrical connector, comprising an insulated housing having a plurality of channels formed therein, including at least first and second adjacent channels having respective portions separated therefrom by a wall, the wall having at least a portion thereof which is substantially deformable, a plurality of contacts including at least first and second contacts slidably inserted into the first and second channels, respectively, each of the contacts being longitudinal and including an intermediate body portion having first and second side edges, respectively, the first side edge including a portion protruding laterally therefrom, and the second side edge including a recessed portion, such that the protruding portion of the first side edge of the second contact cooperates with the recessed portion of the second side edge of the first contact to trap the portion of the wall therebetween, and such that the portion of the wall is deformed during the slidable insertion of the first and second contacts into the first and second channels, respectively, thereby providing a lateral biasing force on the respective contacts to interlock the contacts in the connector for improved retention of the contacts in the respective channels.

* * * * *